US005497738A

United States Patent [19]

Siemon et al.

[11] Patent Number: 5,497,738

[45] **Date of Patent: * Mar. 12, 1996**

[54] VCT CONTROL WITH A DIRECT ELECTROMECHANICAL ACTUATOR

[75] Inventors: Edward C. Siemon; Stanley B. Quinn, Jr., both of Ithaca, N.Y.

[73] Assignee: Borg-Warner Automotive, Inc., Sterling Heights, Mich.

[ * ] Notice: The portion of the term of this patent subsequent to Jun. 15, 2010, has been disclaimed.

[21] Appl. No.: 56,635

[22] Filed: May 3, 1993

Related U.S. Application Data

[63] Continuation-in-part of Ser. No. 940,273, Sep. 3, 1992, Pat. No. 5,218,935.

[51] Int. Cl.[6] ..... F01L 1/34

[52] U.S. Cl. ..... 123/90.17; 123/90.31; 137/312

[58] Field of Search ..... 123/90.15, 90.17, 123/90.31; 74/568 R; 137/312, 625.65; 464/1, 2, 160

[56] References Cited

U.S. PATENT DOCUMENTS

| | | | |
|---|---|---|---|
| 4,762,141 | 8/1988 | Karpis | 137/312 |
| 4,856,465 | 8/1989 | Denz et al. | 123/90.17 |
| 4,858,572 | 8/1989 | Shirai et al. | 123/90.12 |
| 5,000,420 | 3/1991 | Hendrixon | 137/625.65 |
| 5,012,774 | 5/1991 | Strauber et al. | 123/90.17 |
| 5,056,477 | 10/1991 | Linder et al. | 123/90.17 |
| 5,088,456 | 2/1992 | Suga | 123/90.17 |
| 5,150,671 | 9/1992 | Suga | 123/90.17 |
| 5,172,659 | 12/1992 | Butterfield et al. | 123/90.17 |
| 5,201,289 | 4/1993 | Imai | 123/90.17 |
| 5,218,935 | 6/1993 | Quinn, Jr. et al. | 123/90.17 |
| 5,271,360 | 12/1993 | Kano et al. | 123/90.17 |

*Primary Examiner*—Weilun Lo

*Attorney, Agent, or Firm*—Willian Brinks Hofer et al.; Greg Dziegielewski

[57] ABSTRACT

A camshaft (126) has a vane (160) secured to an end thereof for non-oscillating rotation therewith. The camshaft also carries a sprocket (132) which can rotate with the camshaft but which is also oscillatable with the camshaft. The vane has opposed lobes (**160*a*, 160*b*) which are received in opposed recesses (132*a*, 132*b*), respectively, of the sprocket. The recesses have greater circumferential extent than the lobes to permit the vane and sprocket to oscillate with respect to one another, and thereby permit the camshaft to change in phase relative to a crankshaft whose phase relative to the sprocket is fixed by virtue of a chain drive extending therebetween. The camshaft tends to change in reaction to pulses which it experiences during its normal operation, and it is permitted to change only in a given direction, either to advance or retard, by selectively blocking or permitting the flow of hydraulic fluid, preferably engine oil, through the return lines (194, 196) from the recesses by controlling the position of a vented spool (200) within a valve body (198) of a control valve (192) in response to a signal indicative of an engine operating condition from an engine control unit (208) via cable (238). The vented spool is selectively positioned within the valve body by a electromechanical actuator (201**) which is controlled by the engine control unit. The spool is centered when an optimum phase angle between crankshaft and camshaft is achieved.

13 Claims, 13 Drawing Sheets

VCT CONTROL WITH A DIRECT ELECTROMECHANICAL ACTUATOR

CROSS REFERENCE TO APPLICATION

This application is a continuation-in-part of application Ser. No. 940,273 which was filed Sep. 3, 1992, now U.S. Pat. No. 5,218,935, granted Jun. 15, 1993.

FIELD OF THE INVENTION

This invention relates to an hydraulic control system for controlling the operation of a variable camshaft timing (VCT) system of the type in which the position of the camshaft is circumferentially varied relative to the position of a crankshaft in reaction to torque reversals experienced by the camshaft during its normal operation. In such a VCT system, an electromechanical/hydraulic system is provided to effect the repositioning of the camshaft in reaction to such torque reversals, and a control system is provided to selectively permit or prevent the hydraulic system from effecting such repositioning.

More specifically, the present invention relates to a control system which utilizes a variable force solenoid to directly control the position of a fully vented spool valve which is an useful part of the hydraulic system.

BACKGROUND OF THE INVENTION

Consideration of information disclosed by the following U.S. Patents, which are all hereby incorporated by reference, is useful when exploring the background of the present invention.

U.S. Pat. No. 5,002,023 describes a VCT system within the field of the invention in which the system hydraulics includes a pair of oppositely acting hydraulic cylinders with appropriate hydraulic flow elements to selectively transfer hydraulic fluid from one of the cylinders to the other, or vice versa, to thereby advance or retard the circumferential position on of a camshaft relative to a crankshaft. The control system utilizes a control valve in which the exhaustion of hydraulic fluid from one or another of the oppositely acting cylinders is permitted by moving a spool within the valve one way or another from its centered or null position. The movement of the spool occurs in response to an increase or decrease in control hydraulic pressure, $P_C$, on one end of the spool and the relationship between the hydraulic force on such end and an oppositely direct mechanical force on the other end which results from a compression spring that acts thereon.

U.S. Pat. No. 5,107,804 describes an alternate type of VCT system within the field of the invention in which the system hydraulics include a vane having lobes within an enclosed housing which replace the oppositely acting cylinders disclosed by the aforementioned U.S. Pat. No. 5,002,023. The vane is oscillatable with respect to the housing, with appropriate hydraulic flow elements to transfer hydraulic fluid within the housing from one side of a lobe to the other, or vice versa, to thereby oscillate the vane with respect to the housing in one direction or the other, an action which is effective to advance or retard the position of the camshaft relative to the crankshaft. The control system of this VCT system is identical to that divulged in U.S. Pat. No. 5,002,023, using the same type of spool valve responding to the same type of forces acting thereon.

U.S. Pat. Nos. 5,172,659 and 5,184,578 both address the problems of the aforementioned types of VCT systems created by the attempt to balance the hydraulic force exerted against one end of the spool and the mechanical force exerted against the other end. The improved control system disclosed in both U.S. Pat. Nos. 5,172,659 and 5,184,578 utilizes hydraulic force on both ends of the spool. The hydraulic force on one end results from the directly applied hydraulic fluid from the engine oil gallery at full hydraulic pressure, $P_S$. The hydraulic force on the other end of the spool results from an hydraulic cylinder or other force multiplier which acts thereon in response to system hydraulic fluid at reduced pressure, $P_C$, from a PWM solenoid. Because the force at each of the opposed ends of the spool is hydraulic in origin, based on the same hydraulic fluid, changes in pressure or viscosity of the hydraulic fluid will be self-negating, and will not affect the centered or null position of the spool. There are, however, several disadvantages inherent in the inventions disclosed in the '659 and '578 patents.

One disadvantage is the inability of this differential pressure control system ("DPCS") to properly control the position of the spool during the initial start-up phase of the engine. When the engine first starts, it takes several seconds for oil pressure to develop. During that time, the position of the spool valve is unknown. Because the system logic has no known quantity with which to perform the necessary calculations, the DPCS is prevented from effectively controlling the spool valve position until the engine reaches normal operating speed.

Another problem with existing VCT systems is sluggish dynamic response. Even after the engine stabilizes at normal operating speed, individual characteristics vary substantially from engine to engine. A new engine at high speed and low temperature can have a drastically different oil pressure than a worn engine at hot idle. Current methods employed to allow operation over such a wide spectrum of engine characteristics (such as increased cross-sectional area of the hydraulic piston and the undersizing of springs) result in a slow response time, requiring relatively low closed-loop controller gains to maintain stability.

The low closed-loop controller gains render the system more sensitive to component tolerances and operating environment. The net effects (such as a change in the PWM duty cycle required to achieve a null position of the spool) cause degradation of overall closed-loop system performance.

Finally, the moving parts of the PWM solenoid typically used in a conventional DPCS create unwanted noise in the system. During operation, the solenoid cycles through its full stroke with every PWM pulse. The rapid cycling results in armature and poppet "chatter", i.e., high frequency collisions, thus introducing the unwanted noise.

SUMMARY OF THE INVENTION

The present invention provides an improved method and apparatus for controlling the position of a vented spool in a hydraulic control valve. Specifically, the present invention provides an improved method and apparatus for controlling the position of a vented spool in a hydraulic control valve in a VCT system, for example, a hydraulic control valve similar to the one used in an oppositely-acting hydraulic cylinder VCT timing system of the type disclosed in U.S. Pat. No. 5,002,023, or a hydraulic control valve similar to the one used in a vane-type VCT timing system of the type disclosed in U.S. Pat. No. 5,107,804.

The control system, of the present invention eliminates the hydraulic force on one end of the spool resulting from directly applied hydraulic fluid from the engine oil gallery at full hydraulic pressure, $P_S$, utilized by previous embodiments of the VCT system. The force on the other end of the vented spool results from an electromechanical actuator, preferably of the variable force solenoid type, which acts directly upon the vented spool in response to an electronic signal issued from an engine control unit ("ECU") which monitors various engine parameters. The ECU receives signals from sensors corresponding to camshaft and crankshaft positions and utilizes this information to calculate a relative phase angle. The preferred embodiment employs a closed-loop feedback system, such as the one disclosed in U.S. Pat. No. 5,184,578, which corrects for any phase angle error. The present invention offers an efficient and economical solution to the problems recited above, as well as additional advantages over the conventional DPCS.

When the relationship between spool position and control signal (solenoid current) is independent of engine oil pressure, any problems associated with oil pressure or its fluctuation are eliminated. For example, the lack of normal operating oil pressure during initial engine start-up does not result in start-up error because the signal from the ECU is fed immediately to the solenoid which directly positions the spool.

The use of a variable force solenoid also solves the problem of sluggish dynamic response. Such a device can be designed to be as fast as the mechanical response of the spool valve, and certainly much faster than the conventional (fully hydraulic) DPCS. The faster response allows the use of increased closed-loop gain, making the system less sensitive to component tolerances and operating environment.

Also, a variable force solenoid armature only travels a short distance, as controlled by the current from the ECU, as opposed to the complete cycles which result from the use of a PWM solenoid. Because the travel required rarely results in extremes, the chattering is eliminated, rendering the system virtually noise-free.

Possibly the most important advantage over the conventional DPCS is the improved control of the basic system. The present invention provides a greatly enhanced ability to quickly and accurately follow a command input of VCT phase.

Furthermore, because the preferred embodiment of the present invention is not dependent upon oil pressure, the present invention can be used for applications where an oil-free actuator is desirable, such as with timing belt engines.

In an alternate embodiment, a lever arrangement or equivalent is functionally positioned between the electromechanical actuator and the spool. The lever arrangement effectively acts as a stroke amplifier/force attenuator, allowing either a reduction in the required solenoid current or reduction in the air gap distance without sacrificing valve travel.

Accordingly, it is an object of the present invention to provide an improved method and apparatus for controlling the operation of a hydraulic control valve of the vented spool type. It is a further object of the present invention to provide an improved method and apparatus for controlling the operation of a hydraulic control valve of the vented spool type in an automotive variable camshaft timing system.

For a further understanding of the present invention and the objects thereof, attention is directed to the drawings and the following brief description thereof, to the detailed description of the preferred embodiment, and to the appended claims.

DETAILED DESCRIPTION OF THE PREFERRED EMBODIMENT

Figure 1:
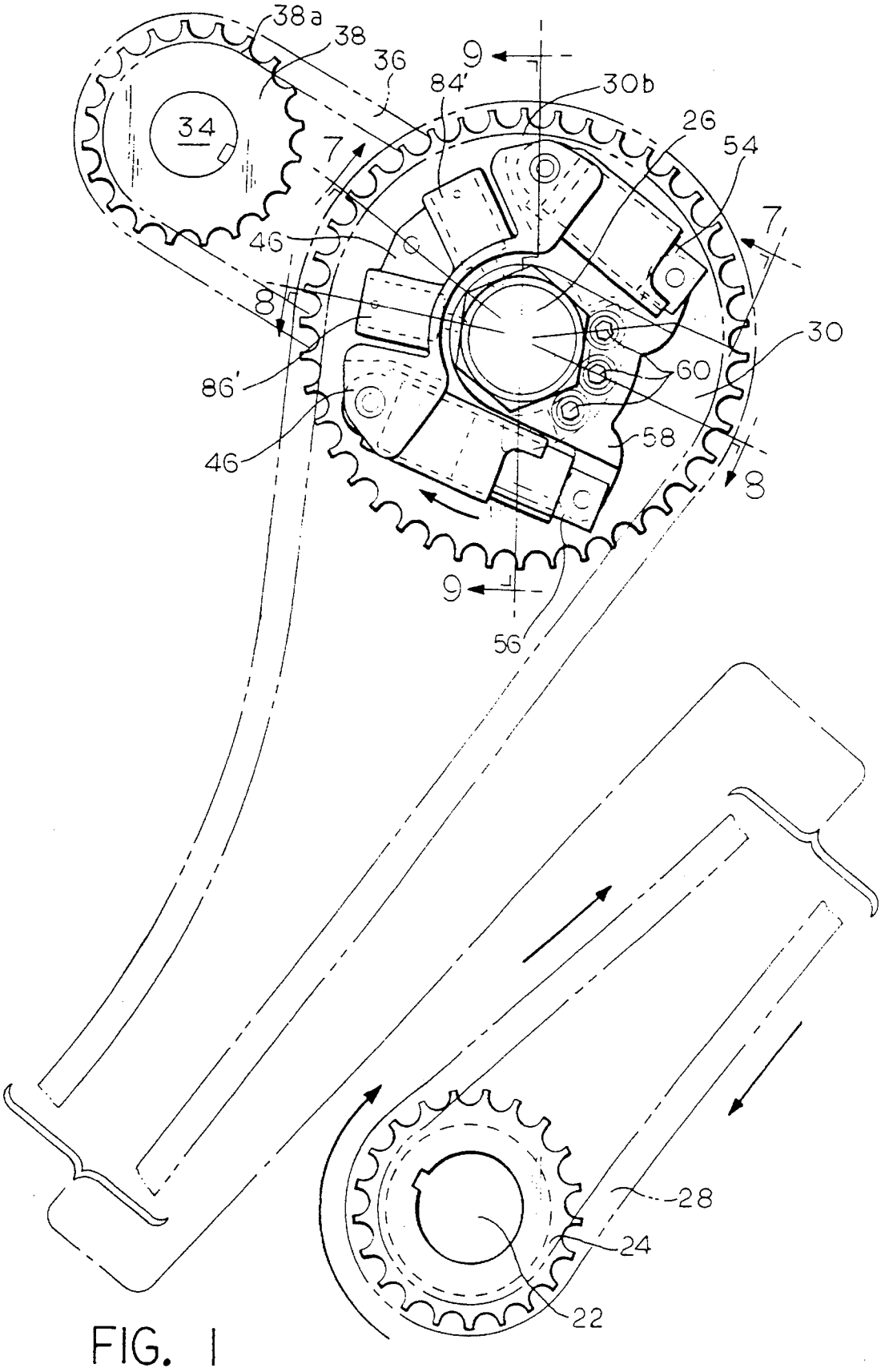
FIG. 1 is a fragmentary view of a dual camshaft internal combustion engine incorporating an embodiment of a variable camshaft timing arrangement according to the present invention, the view being taken on a plane extending transversely through the crankshaft and the camshafts and showing the intake camshaft in a retarded position relative to the crankshaft and the exhaust camshaft.

In the embodiment of FIGS. 1–9, a crankshaft 22 has a sprocket 24 keyed thereto, and rotation of the crankshaft 22 during the operation of the engine in which it is incorporated, otherwise not shown, is transmitted to an exhaust camshaft 26, that is, a camshaft which is used to operate the exhaust valves of the engine, by a chain 28 which is trained around the sprocket 24 and a sprocket 30 which is keyed to the camshaft 26. Although not shown, it is to be understood that suitable chain tighteners will be provided to ensure that the chain 28 is kept tight and relatively free of slack. As shown, the sprocket 30 is twice as large as the sprocket 24. This relationship results in a rotation of the camshaft 26 at a rate of one-half that of the crankshaft 22, which is proper for a 4-cycle engine. It is to be understood that the use of a belt in place of the chain 28 is also contemplated.

Figure 6:
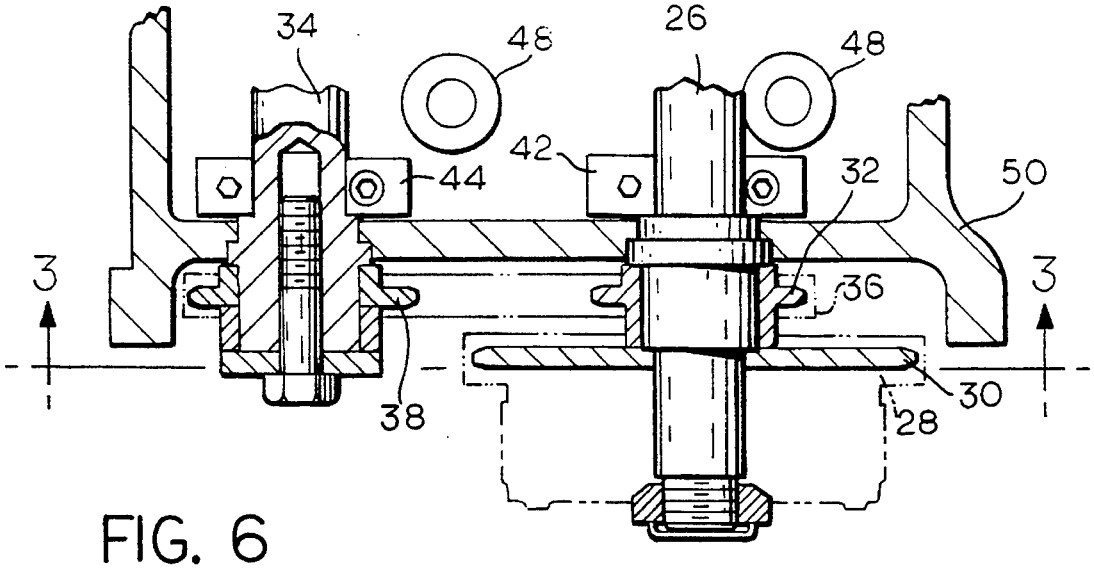
FIG. 6 is a fragmentary view taken on line 6—6 of FIG. 4.
Figure 3:
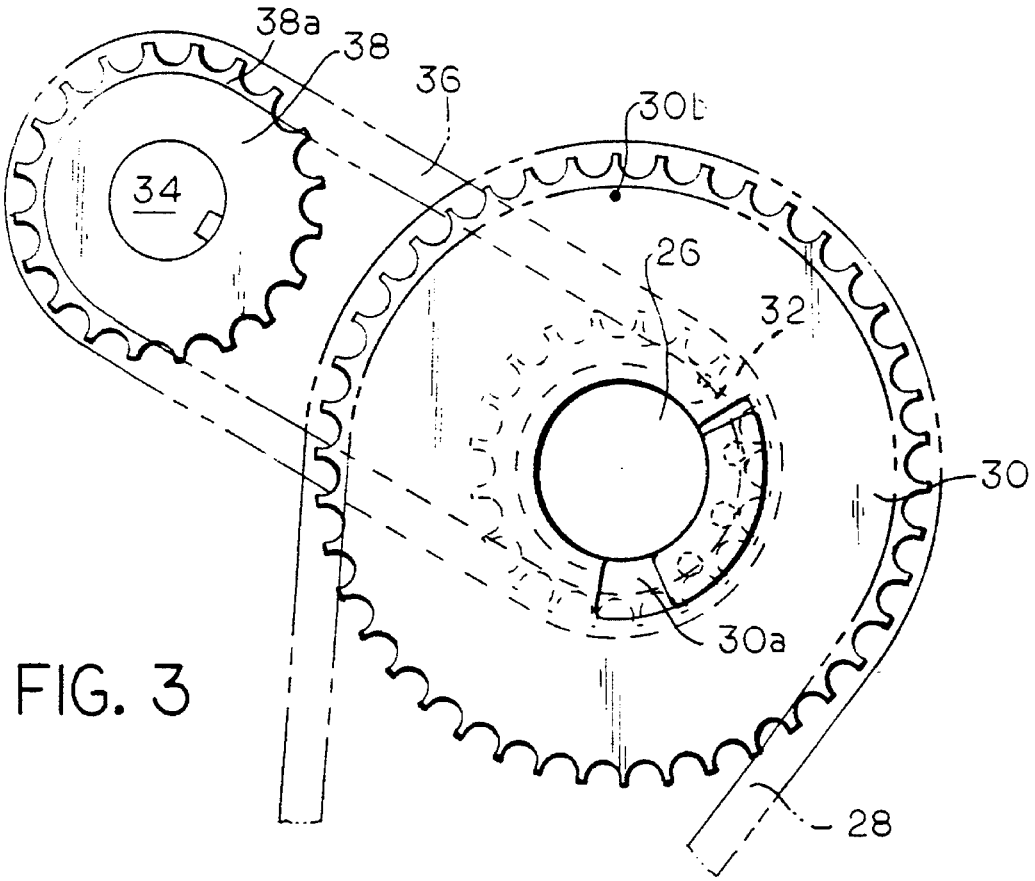
FIG. 3 is a fragmentary view taken on line 3—3 of FIG. 6 with some of the structure being removed for the sake of clarity and being shown in the retarded position of the device.
Figure 5:
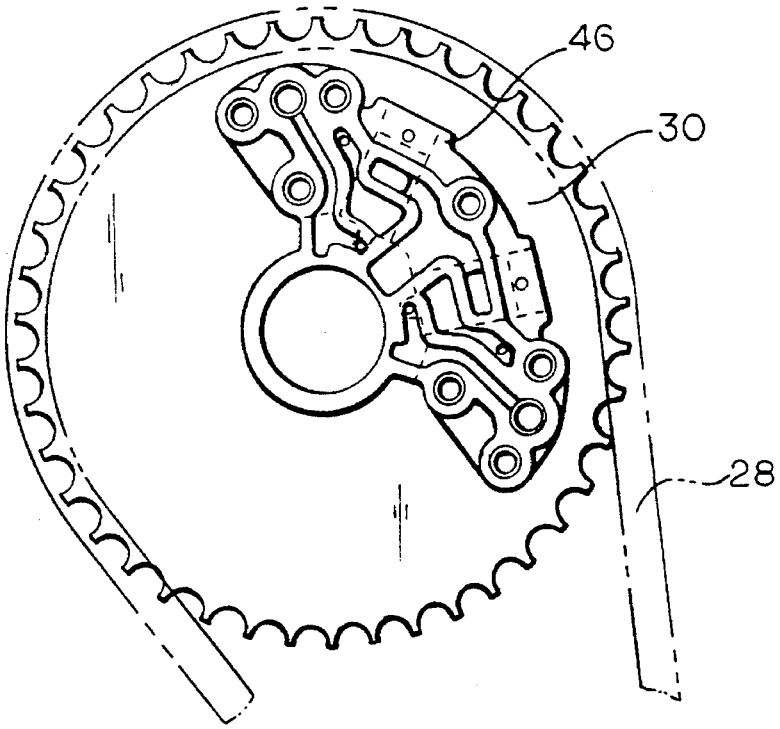
FIG. 5 is a fragmentary view showing the reverse side of some of the structure illustrated in FIG. 1.
Figure 4:
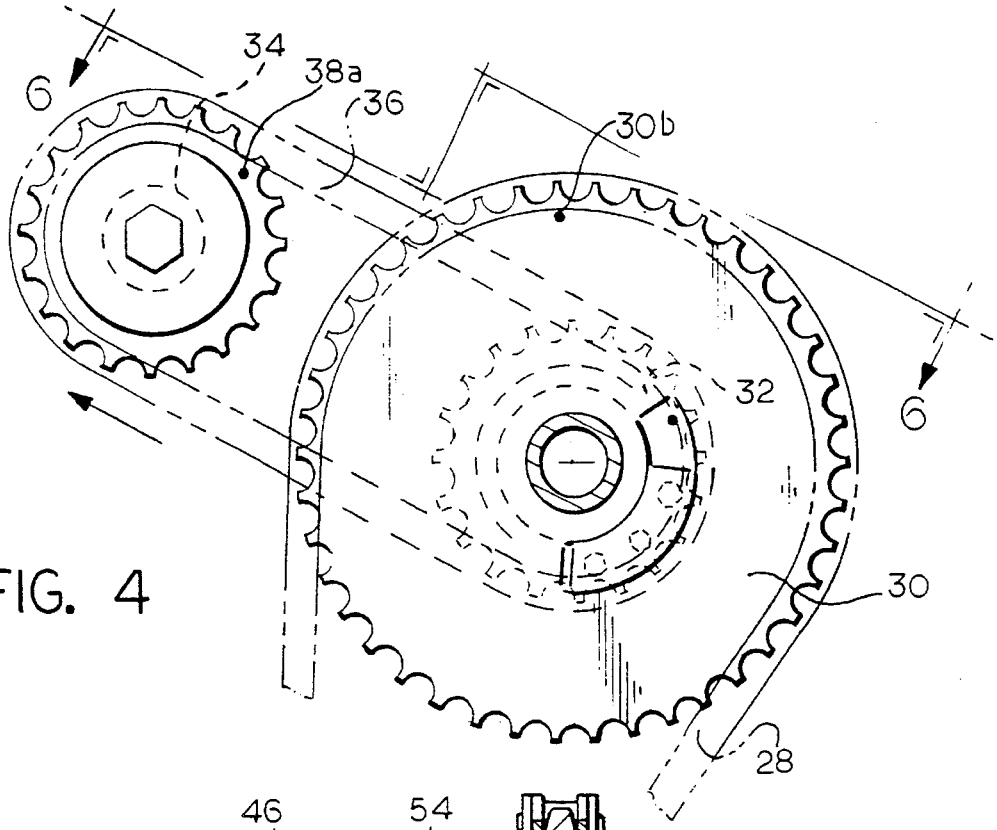
FIG. 4 is a fragmentary view similar to FIG. 3 showing the intake camshaft in an advanced position relative to the exhaust camshaft.
Figure 9:
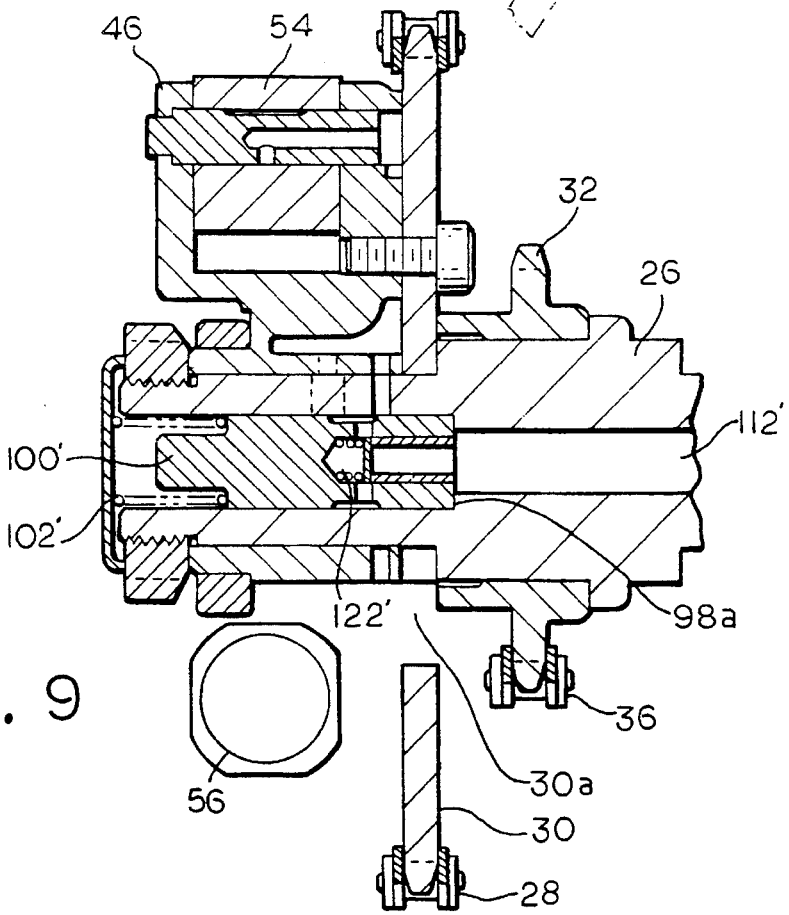
FIG. 9 is a sectional view taken on line 9—9 of FIG. 1.
Figure 7:
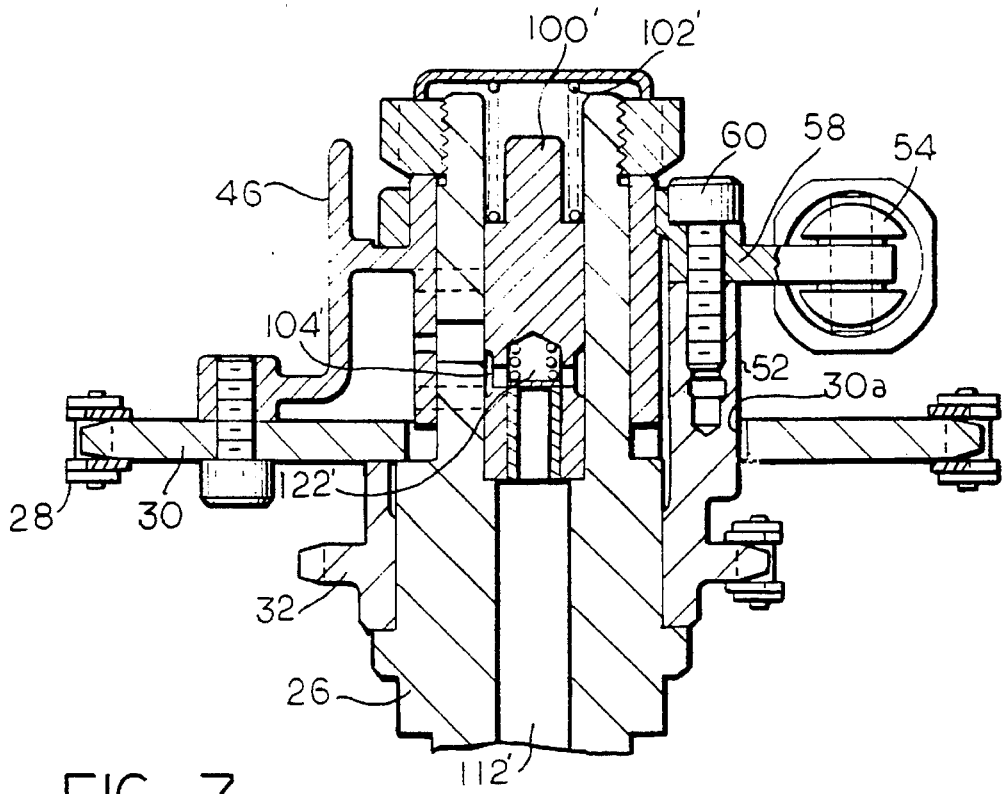
FIG. 7 is a fragmentary view taken on line 7—7 of FIG. 1.
Figure 8:
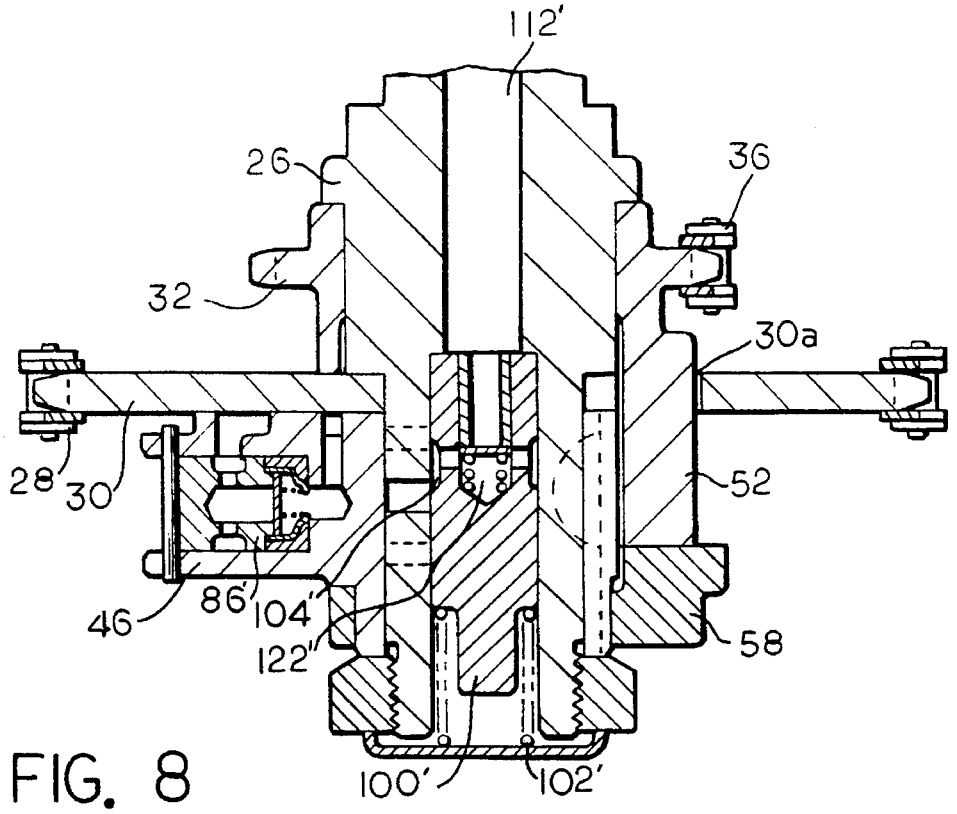
FIG. 8 is a sectional view taken on line 8—8 of FIG. 1.
Figure 10:
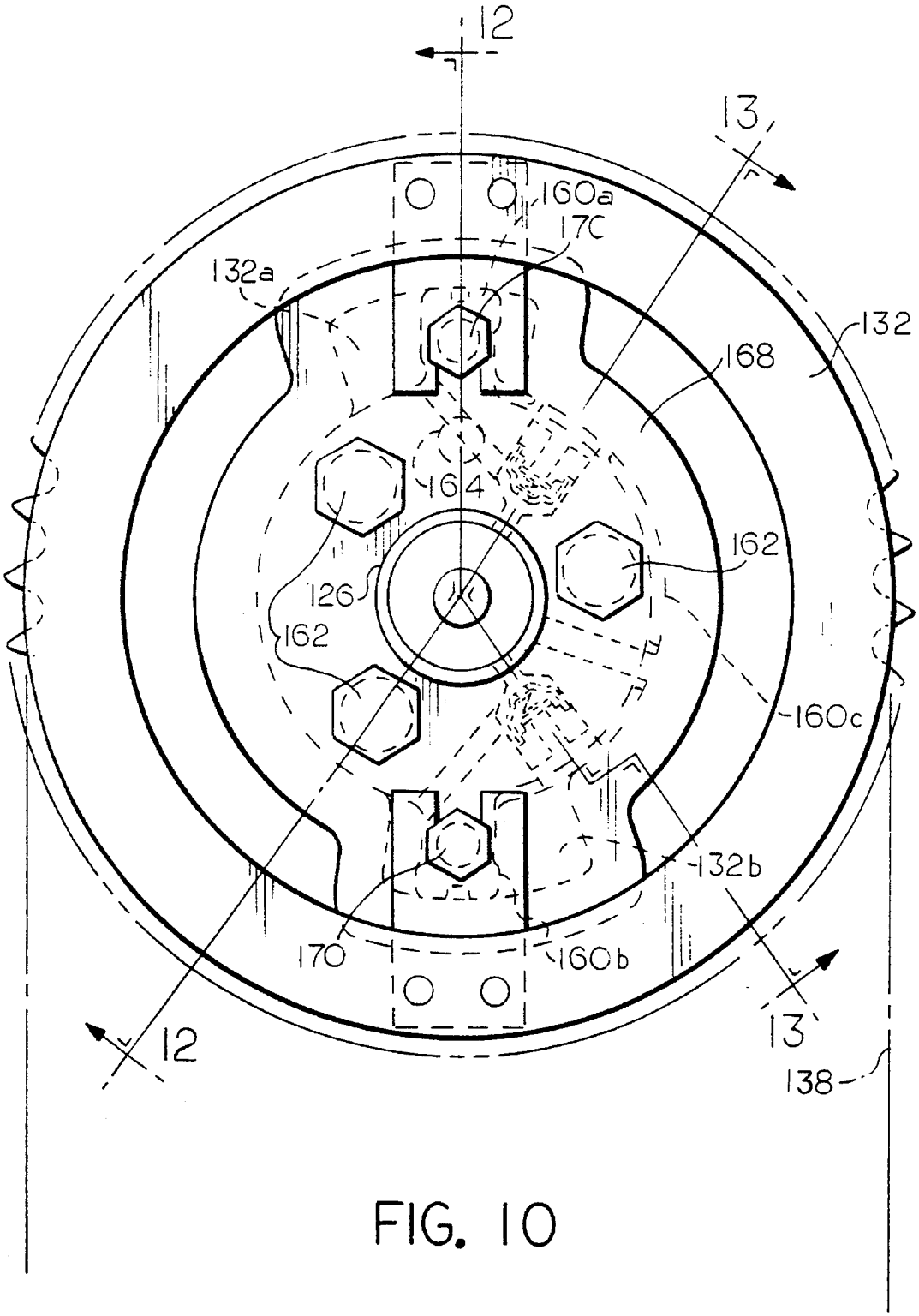
FIG. 10 is an end elevational view of a camshaft with an alternative embodiment of a variable camshaft timing system applied thereto.
Figure 11:
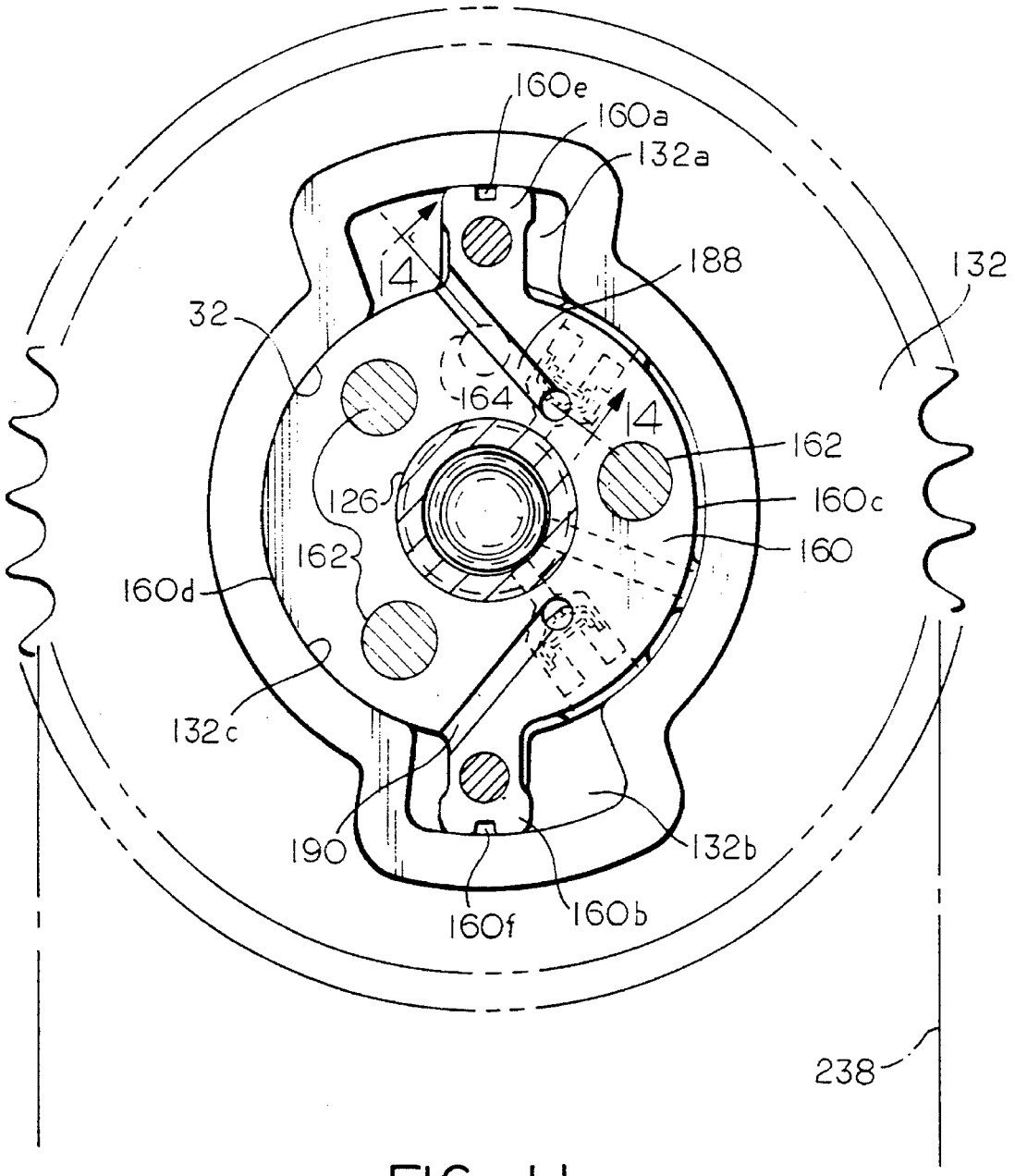
FIG. 11 is a view similar to FIG. 10 with a portion of the structure thereof removed to more clearly illustrate other portions thereof.
Figure 12:
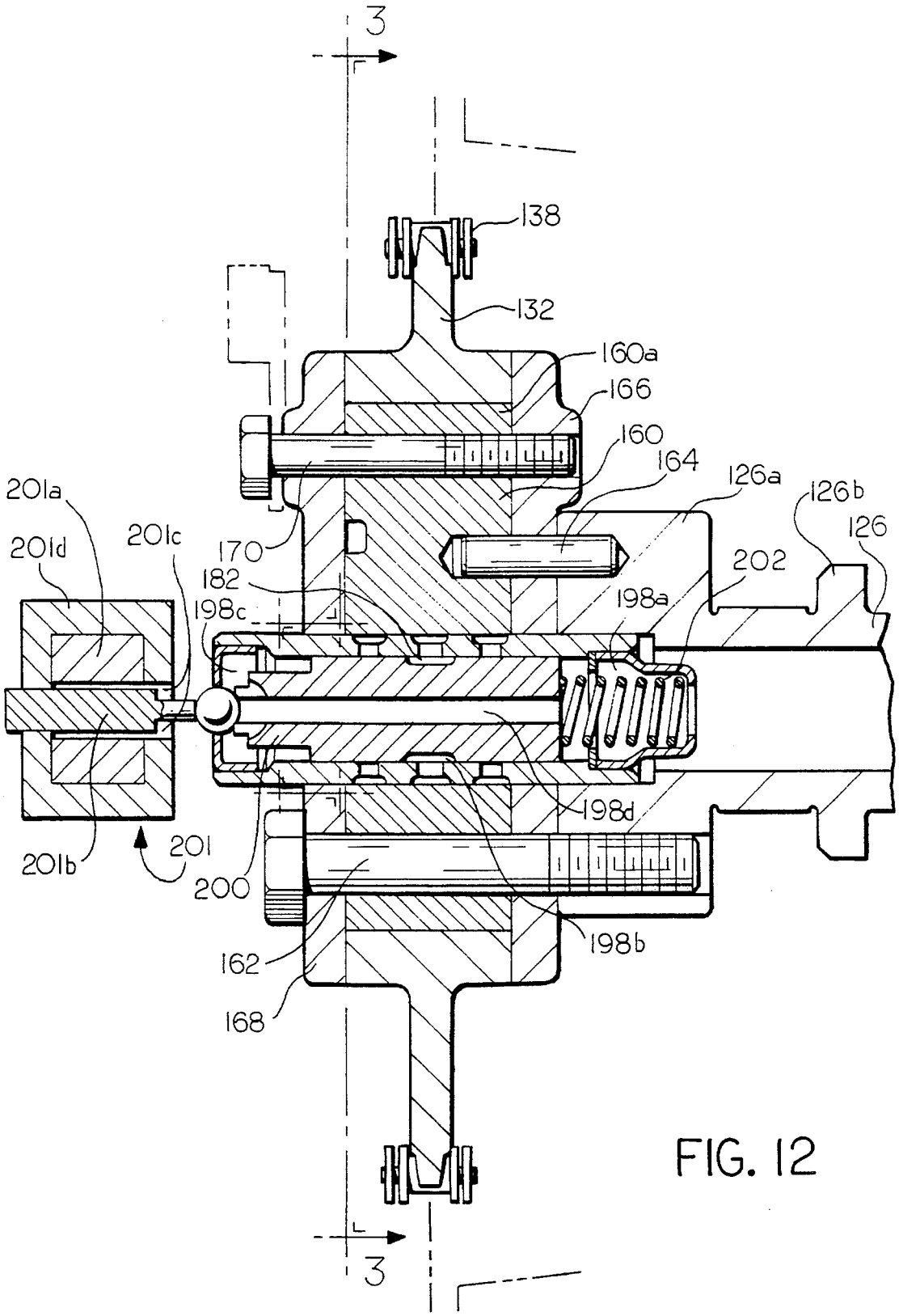
FIG. 12 is a sectional view taken on line 12—12 of FIG. 10.
Figure 13:
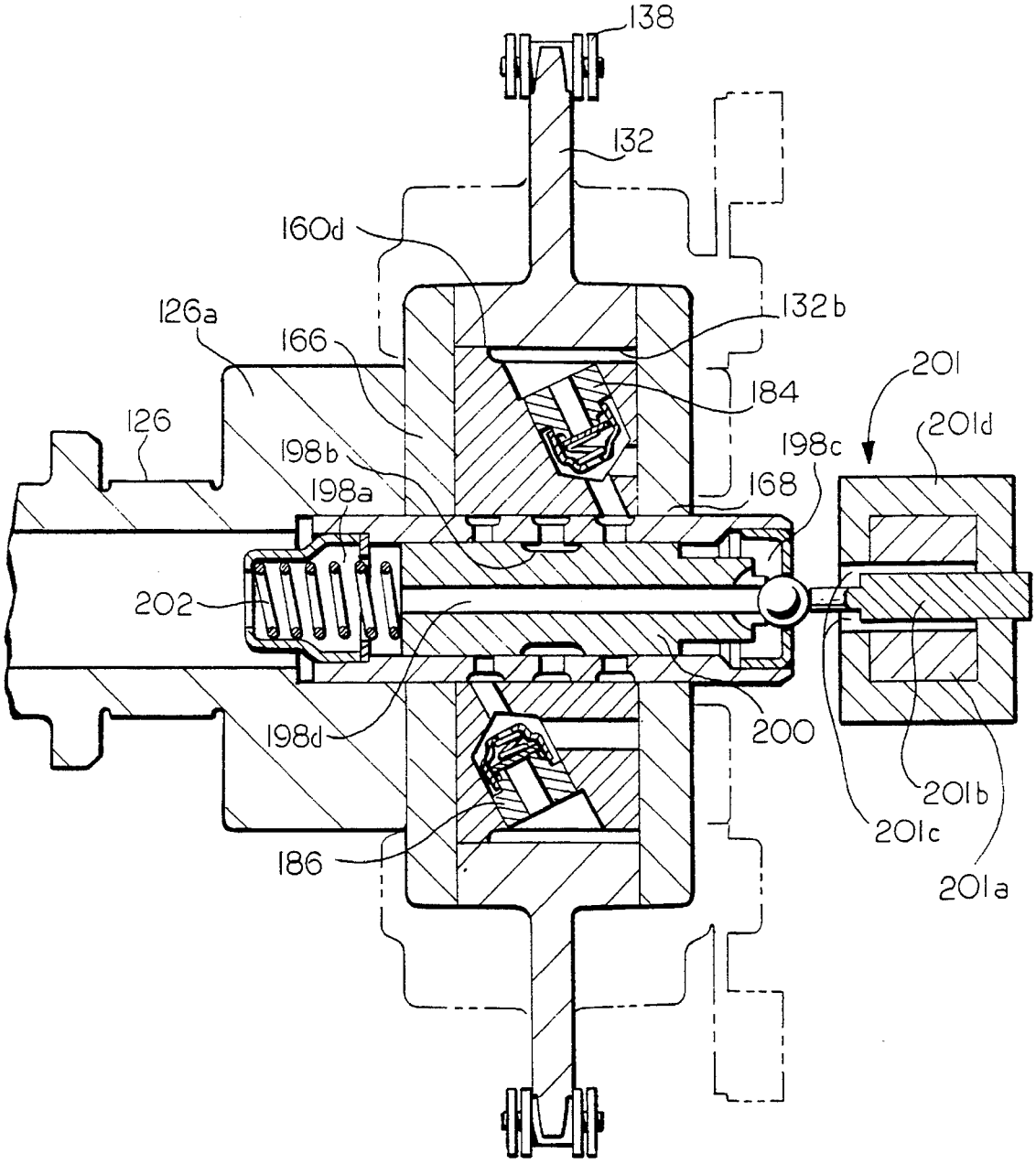
FIG. 13 is a sectional view taken on line 13—13 of FIG. 10.
Figure 15:
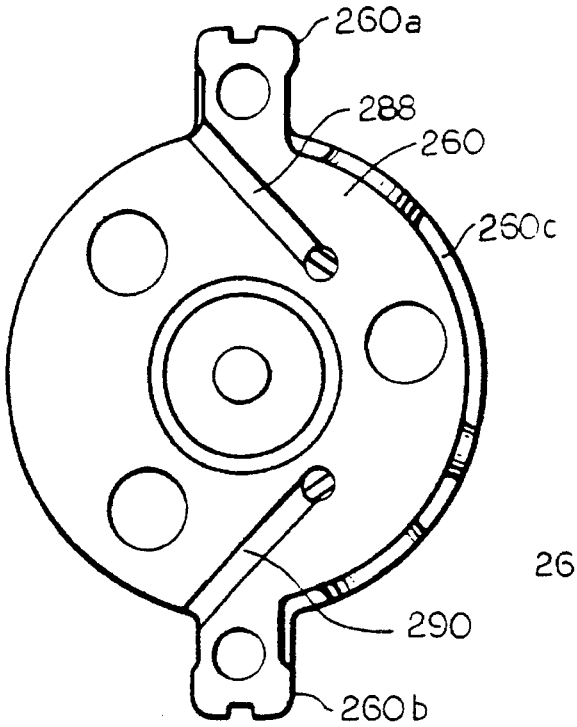
FIG. 15 is an end elevational view of an element of the variable camshaft timing system of FIGS. 10–14.
Figure 16:
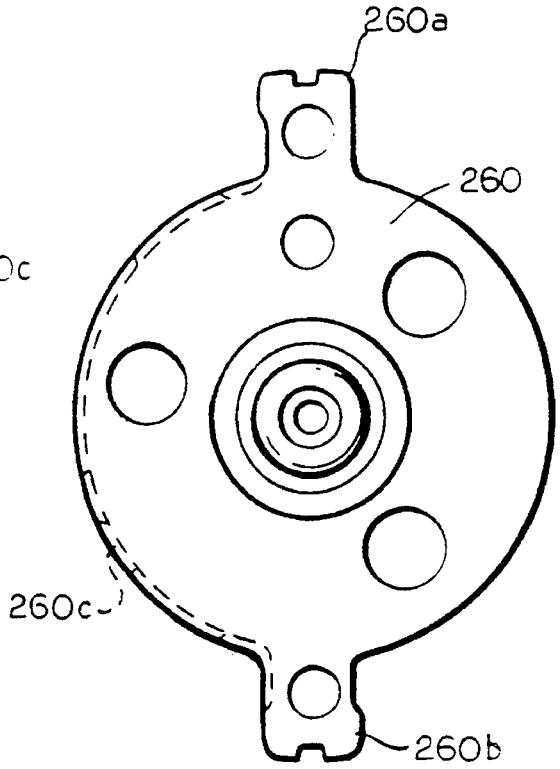
FIG. 16 is an elevational view of the element of FIG. 15 from the opposite end thereof.
Figure 14:
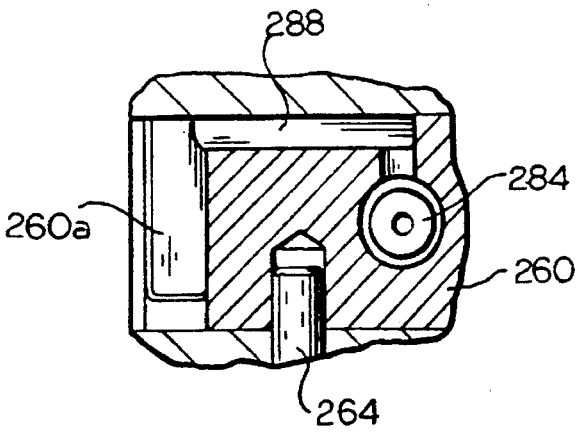
FIG. 14 is a sectional view taken on line 14—14 of FIG. 11.
Figure 17:
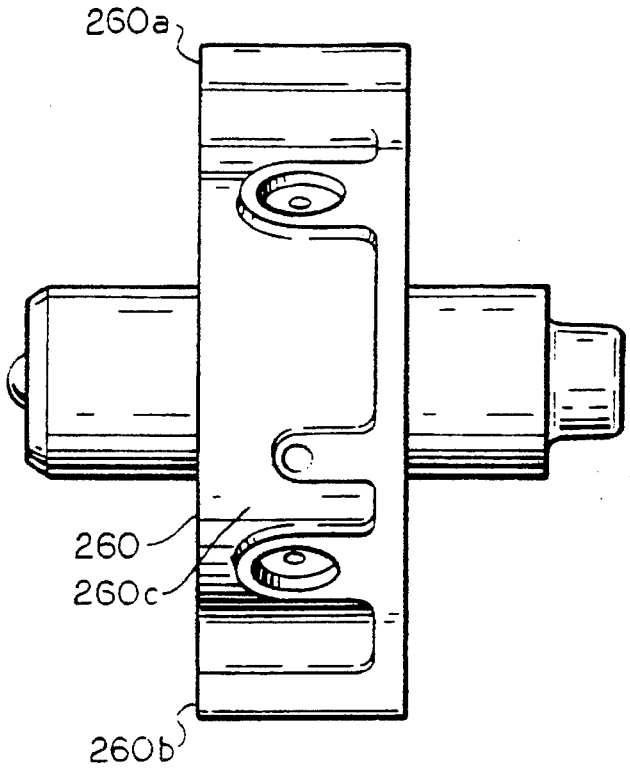
FIG. 17 is a side elevational view of the element of FIGS. 15 and 16.
Figure 18:
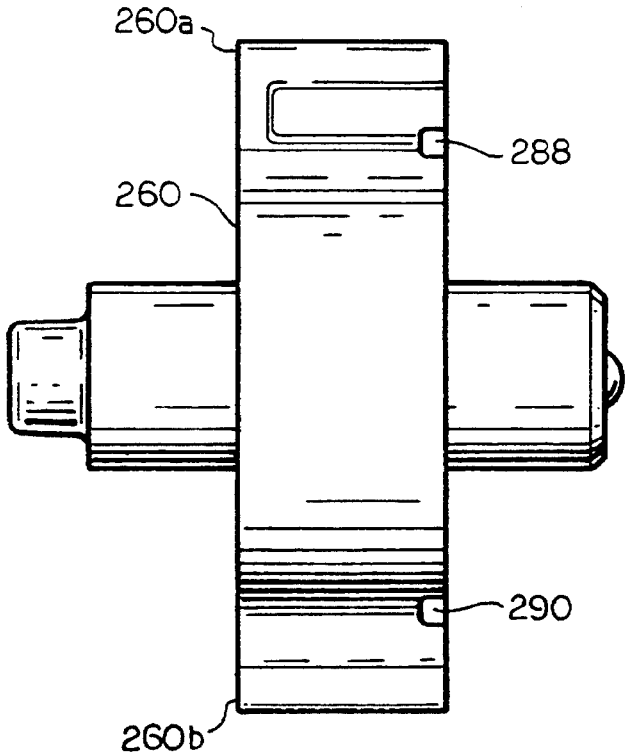
FIG. 18 is an elevational view of the element of FIG. 17 from the opposite side thereof.

The camshaft 26 carries another sprocket, namely sprocket 32, FIG. 3, 4 and 6, journalled thereon to be oscillatable through a limited arc with respect thereto and to be otherwise rotatable with the camshaft 26. Rotation of the camshaft 26 is transmitted to an intake camshaft 34 by a chain 36 which is trained around the sprocket 32 and a sprocket 38 that is keyed to the intake camshaft 34. As shown, the sprockets 32 and 38 are equal in diameter to provide for equivalent rates of rotation between the camshaft 26 and the camshaft 34. The use of a belt in place of the chain 36 is also contemplated.

As is illustrated in FIG. 6, an end of each of the camshafts 26 and 34 is journalled for rotation in bearings 42 and 44, respectively, of the head 50, which is shown fragmentarily and which is bolted to an engine block, otherwise not shown, by bolts 48. The opposite ends of the camshafts 26 and 34, not shown, are similarly journalled for rotation in an opposite end, also not shown, of the head 50. The sprocket 38 is keyed to the camshaft 34 at a location of the camshaft 34 which is outwardly of the head 50. Similarly, the sprockets 32 and 30 are positioned, in series, on the camshaft 26 at locations outwardly of the head 50, the sprocket 32 being transversely aligned with the sprocket 38 and the sprocket 30 being positioned slightly outwardly of the sprocket 32, to be transversely aligned with the sprocket 24.

Figure 2:
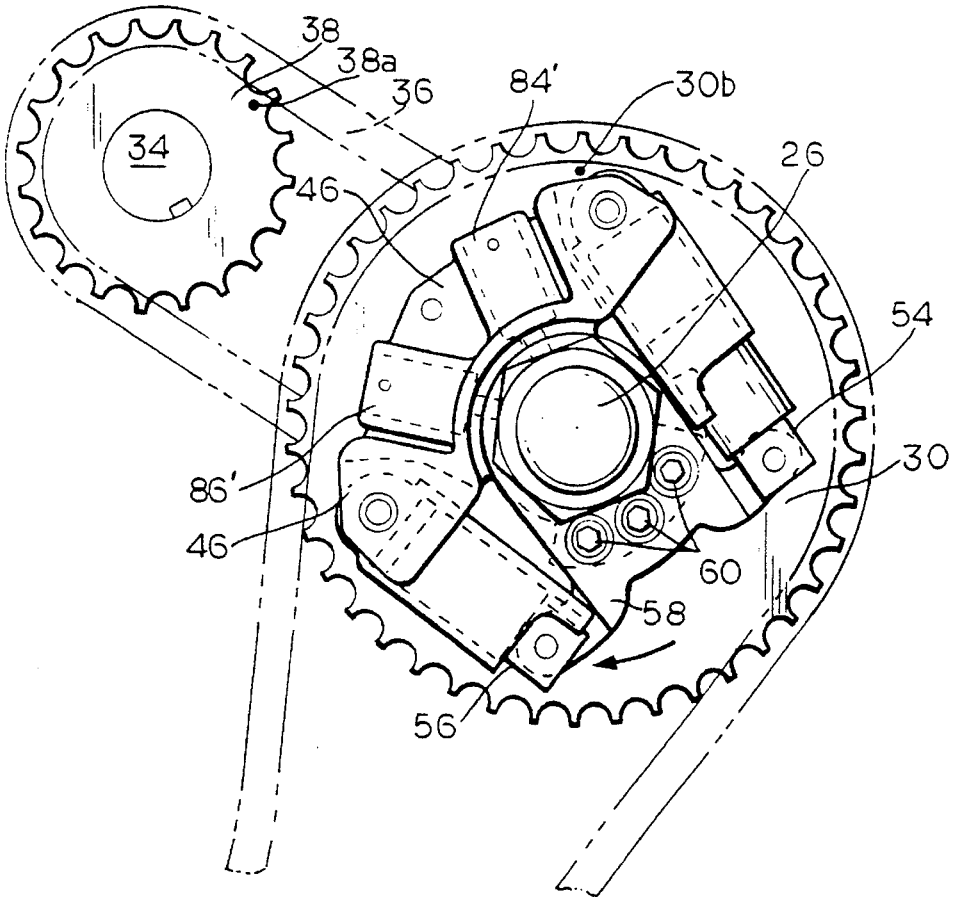
FIG. 2 is a fragmentary view similar to a portion of FIG. 1 showing the intake camshaft in an advanced position relative to the exhaust camshaft.

The sprocket 32 has an arcuate retainer 52 (FIGS. 7 and 8) as an integral part thereof, and the retainer 52 extends outwardly from the sprocket 32 through an arcuate opening **30*a* in the sprocket 30. The sprocket 30 has an arcuate hydraulic body 46 bolted thereto and the hydraulic body 46, which houses certain of the hydraulic components of the associated hydraulic control system, receives and pivotally supports the body end of each of a pair of oppositely acting, single acting hydraulic cylinders 54 and 56 which are positioned on opposite sides of the longitudinal axis of the camshaft 26. The piston ends of the cylinders 54 and 56 are pivotally attached to an arcuate bracket 58, and the bracket 58 is secured to the sprocket 32 by a plurality of threaded fasteners 60. Thus, by extending one of the cylinders 54 and 56 and by simultaneously retracting the other of the cylinders 54 and 56, the arcuate position of the sprocket 32 will be changed relative to the sprocket 30, either to advance the sprocket 32 if the cylinder 54 is extended and the cylinder 56 is retracted, which is the operating condition illustrated in FIGS. 2 and 4, or to retard the sprocket 32 relative to the sprocket 30 if the cylinder 56 is extended and the cylinder 54 is retracted, which is the operating condition illustrated in FIGS. 1, 3, 7 and 8. In either case, the retarding or advancing of the position of the sprocket 32 relative to the position of the sprocket 30, which is selectively permitted or prevented in reaction to the direction of torque in the camshaft 26, as explained in the aforesaid U.S. Pat. No. 5,002,023, will advance or retard the position of the camshaft 34 relative to the position of the camshaft 26 by virtue of the chain drive connection provided by the chain 36 between the sprocket 32, which is journalled for limited relative arcuate movement on the camshaft 26, and the sprocket 38, which is keyed to the camshaft 34. This relationship can be seen in the drawing by comparing the relative position of a timing mark 30*b* on the sprocket 30 and a timing mark 38*a* on the sprocket 38 in the retard position of the camshaft 34, as is shown in FIGS. 1 and 3, to their relative positions in the advanced position of the camshaft 34, as is shown in FIGS. 2 and 4**.

FIGS. 10–20 illustrate two embodiments of the present invention in which a housing in the form of a sprocket 132 is oscillatingly journalled on a camshaft 126. The camshaft 126 may be considered to be the only camshaft of a single camshaft engine, either of the overhead camshaft type or the in block camshaft type. Alternatively, the camshaft 126 may be considered to be either the intake valve operating camshaft or the exhaust valve operating camshaft of a dual camshaft engine. In any case, the sprocket 132 and the camshaft 126 are rotatable together, and are caused to rotate by the application of torque to the sprocket 132 by an endless roller chain 138, shown fragmentarily, which is trained around the sprocket 132 and also around a crankshaft, not shown. As will be hereinafter described in greater detail, the sprocket 132 is oscillatingly journalled on the camshaft 126 so that it is oscillatable at least through a limited arc with respect to the camshaft 126 during the rotation of the camshaft, an action which will adjust the phase of the camshaft 126 relative to the crankshaft.

An annular pumping vane 160 is fixedly positioned on the camshaft 126, the vane 160 having a diametrically opposed pair of radially outwardly projecting lobes **160*a*, 160*b* and being attached to an enlarged end portion 126*a* of the camshaft 126 by bolts 162 which pass through the vane 160 into the end portion 126*a*. In that regard, the camshaft 126 is also provided with a thrust shoulder 126*b* to permit the camshaft to be accurately positioned relative to an associated engine block, not shown. The pumping vane 160 is also precisely positioned relative to the end portion 126*a* by a dowel pin 164 which extends therebetween. The lobes 160*a*, 160*b* are received in radially outwardly projecting recesses 132*a*, 132*b*, respectively, of the sprocket 132, the circumferential extent of each of the recesses 132*a*, 132*b* being somewhat greater than the circumferential extent of the vane lobe 160*a*, 160*b* which is received in such recess to permit limited oscillating movement of the sprocket 132 relative to the vane 160. The recesses 132*a*, 132*b* are closed around the lobes 160*a*, 160*b*, respectively, by spaced apart, transversely extending annular plates 166, 168 which are fixed relative to the vane 160, and, thus, relative to the camshaft 126, by bolts 170 which extend from one to the other through the same lobe, 160*a*, 160*b*. Further, the inside diameter 132*c* of the sprocket 132 is sealed with respect to the outside diameter of the portion 160*d* of the vane 160 which is between the lobes 160*a*, 160*b*, and the tips of the lobes 160*a*, 160*b* of the vane 160 are provided with seal receiving slots 160*e*, 160*f*, respectively. Thus each of the recesses 132*a*, 132*b* of the sprocket 132 is capable of sustaining hydraulic pressure, and within each recess 132*a*, 132*b*, the portion on each side of the lobe 160*a*, 160*b***, respectively, is capable of sustaining hydraulic pressure.

Figure 19:
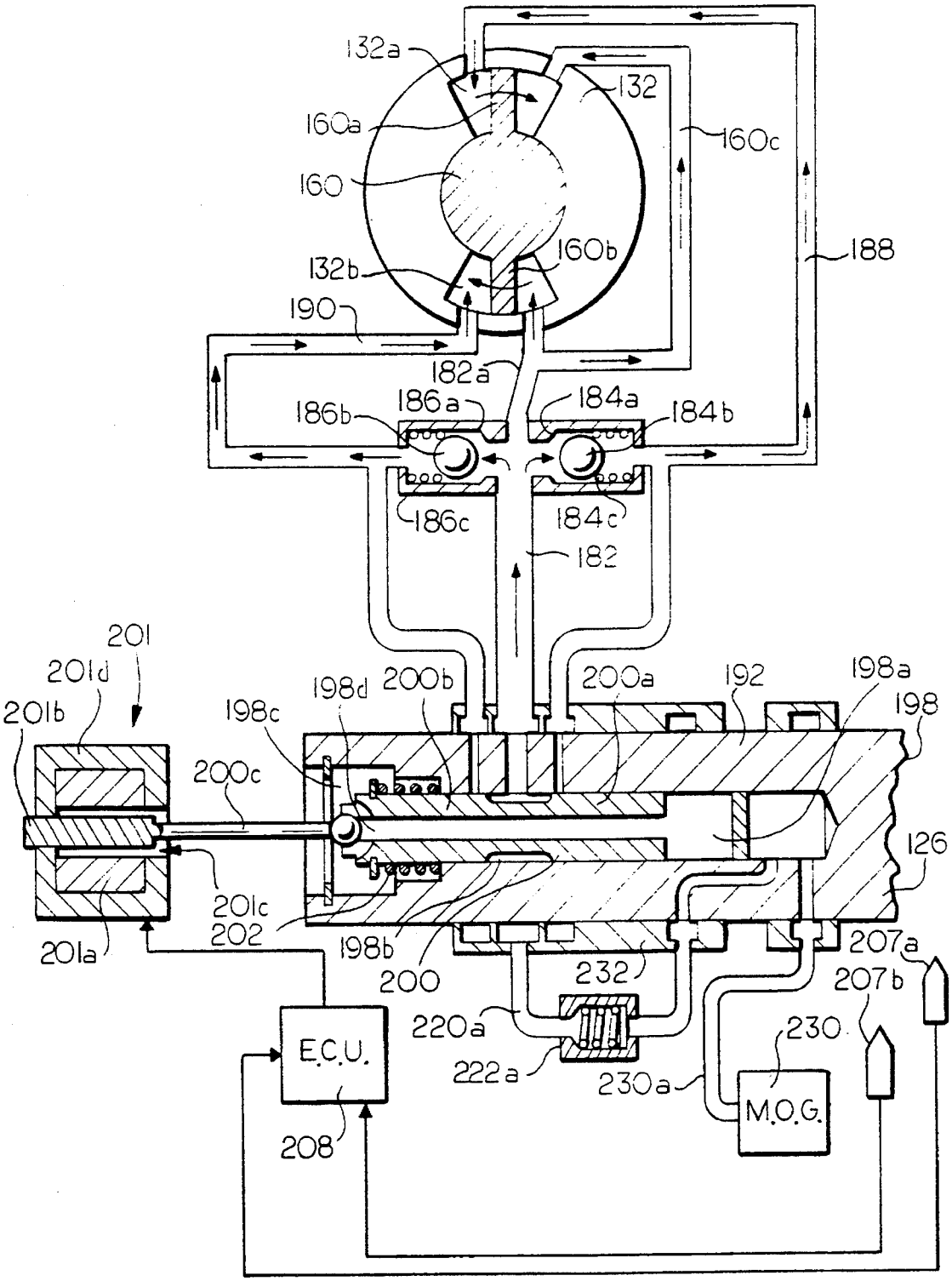
FIG. 19 is a simplified schematic view of the variable camshaft timing arrangement of FIGS. 10–18.
Figure 20:
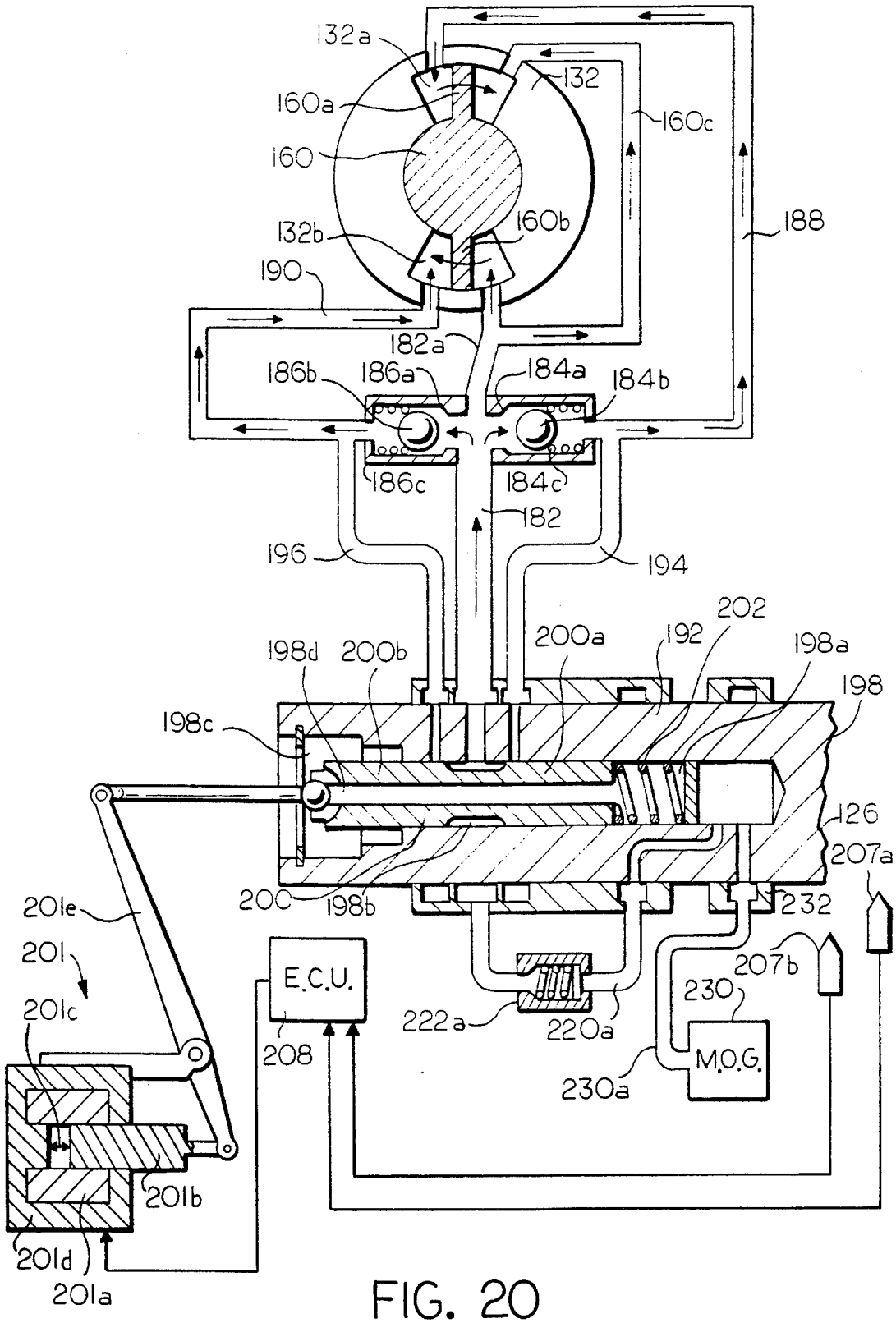
FIG. 20 is a simplified schematic view similar to FIG. 19 of an alternative embodiment of the present invention.

The functioning of the structure of the embodiment of FIGS. 10–18, as thus far described, may be understood by reference to schematic FIGS. 19 and 20. It also is to be understood, however, that the hydraulic control system of FIGS. 19 and 20 is also applicable to an opposed hydraulic cylinder VCT system corresponding to the embodiment of FIGS. 1–9, as well as to a vane type VCT system corresponding to the embodiment of FIGS. 10–18.

In any case, hydraulic fluid, illustratively in the form of engine lubricating oil, flows into the recesses **132*a*, 132*b* by way of common inlet line 182. Inlet line 182 terminates at a juncture between opposed check valves 184 and 186 which are connected to recesses 132***a*, 132*b*, respectively, by branch lines 188, 190, respectively. Check valves 184, 186 have annular seats 184*a*, 186*a*, respectively, to permit the flow of hydraulic fluid through check valves 184, 186 into recesses 132*a*, 132*b*, respectively. The flow of hydraulic fluid through check valves 184, 186 is blocked by floating balls 184*b*, 186*b*, respectively, which are resiliently urged against seats 184*a*, 186*a*, respectively, by springs 184*c*, 186*c*, respectively. Check valves 184, 186, thus, permit the initial filling of recesses 132*a*, 132*b* and provide for a continuous supply of make-up hydraulic fluid to compensate for leakage therefrom. Hydraulic fluid enters inlet line 182 by way of spool valve 192, which is incorporated within camshaft 126, and hydraulic fluid is returned to spool valve 192 from recesses 132*a*, 132*b* by return lines 194, 196, respectively.

Spool valve 192 is made up of cylindrical member 198 and vented spool 200 which is slidable to and fro within cavity 198*a*. Vented spool 200 has cylindrical lands 200*a* and 200*b* on opposed ends thereof, and lands 200*a* and 200*b*, which fit snugly within member 198, are positioned so that land 200*b* will block the exit of hydraulic fluid from return line 196, or land 200*a* will block the exit of hydraulic fluid from return line 194, or lands 200*a* and 200*b* will block the exit of hydraulic fluid from both return lines 194 and 196, as is schematically shown in FIGS. 19 and 20, where camshaft 126 is being maintained in a selected intermediate position relative to the crankshaft of the associated engine, referred to as the "null" position of spool 200.

In the present invention, the position of vented spool 200 within member 198 is influenced by spring 202 which acts on the end of land 200*a*. Thus, spring 202 resiliently urges spool 200 to the left, as oriented in FIGS. 19 and 20. Inlet line 182 receives its pressurized fluid (engine oil) directly from main oil gallery ("MOG") 230 of the engine by way of conduit 230*a*, bypassing vented spool 200. This oil is also used to lubricate bearing 232 in which camshaft 126 of the engine rotates.

The control of the position of spool 200 within member 198 is in direct response to electromechanical actuator 201, preferably a variable force solenoid, as shown in FIG. 19. An electrical current is introduced via cable 238 through solenoid housing 201*d* into solenoid coil 201*a* which repels, or "pushes", armature 201*b* Armature 201*b* bears against extension 200*c* of vented spool 200, thus moving vented spool 200 to the right, as oriented in FIG. 19. If the force of spring 202 is in balance with the force exerted by armature 201*b* in the opposite direction, spool 200 will remain in its null or centered position. Thus, vented spool 200 can be moved in either direction by increasing or decreasing the current to solenoid coil 201*a*, as the case may be. Of course, the configuration of solenoid 201 may be reversed, converting the force on spool extension 200*c* from a "push" to a "pull." This would require the function of spring 202 to be redesigned to counteract the force in the new direction of armature 201*b* movement. However, there are instances when it is desirable for spool 200 to be forced to the far left, or biased, position. The location of spring 202 in cavity 198*c*, as shown in FIG. 19, or in cavity 198*a*, as shown in FIG. 20, ensures the return of spool 200 to its biased position when there is no current applied to solenoid coil 201*a*, such as periods of power failure or engine shutdown.

The movement of armature 201*b* is controlled by an electrical current applied to solenoid coil 201*a* in response to a control signal from electronic engine control unit (ECU) 208, shown schematically in FIG. 19, which may be of conventional construction. In previous versions of the VCT system, the force exerted against spool extension 200*c* must balance with the force of spring 202 plus any system oil pressure in cavity 198*a* acting on the end of land 200*a* if a null position of spool 200 was desired. A problem arose when attempting to achieve this balance because the system included a component which could vary significantly, namely oil pressure. The optimum solution is a control system completely independent of variable parameters, i.e., one independent of engine oil pressure.

In the present invention, oil pressure in cavity 198*a* is relieved, leaving only the force of armature 201*b* to be balanced against the force of spring 202 to achieve a null position of spool 200. Relieving the pressure in cavity 198*a* may be accomplished, for example, by providing an engine oil flow path to the vane system which bypasses spool 200, that is, does not utilize a passage internal to spool 200 to supply oil to inlet line 182, as in previous systems. The bypass of spool 200 may be achieved by connecting bypass line 220*a* directly to inlet line 182 and substituting inlet oil check valve 222*a* for the check valve previously contained in the passage internal to the spool. In conjunction with providing an alternate flow path, venting spool valve 198 to atmosphere via vent 198*d* would complete the objective of relieving the pressure in cavity 198*a* which acted on the end of land 200*a* in previous VCT systems.

With the oil pressure variable eliminated, the only forces left to consider in controlling the position of vented spool 200 are ones with predictable rates of change. The force of armature 201*b* corresponds to the electrical current applied to solenoid coil 201*a*, and the force of spring 202 is also predictable (with respect to spring position). The result is the position of spool 200 being readily ascertainable based on solenoid current alone.

The type of solenoid normally used in the preferred embodiment is the cylindrical armature, or variable area, solenoid shown in FIG. 19. Main air gap 201*c* extends radially around armature 201*b* and may contain nonmagnetic bearing material. As armature 201*c* moves axially, the cylindrical area of main gap 201*c* increases but the force and distance to the coil remain constant. Because the force is relatively insensitive to axial armature position, an extremely precise distance from solenoid housing 201*d* to vented spool 200 is not required.

An alternate embodiment of the present invention is shown in FIG. 20. A variable force solenoid of the flat-faced armature, or variable gap, type is used. Force is inversely proportional to the square of air gap 201*c*. It is thus advantageous to limit air gap 201*c* to a relatively small value. By using a stroke amplifier in conjunction with a variable gap solenoid, a net gain in force can be achieved. Lever arrangement 201*e* connects armature 201*b* with spool extension 200*c* and provides just such a gain in force. This net gain can be exploited by reducing the physical size of electromechanical actuator 201, thus decreasing the current requirements of solenoid coil 201*a* without sacrificing valve travel.

By using only imbalances between an electrically-generated force on one end 200*a* of spool 200 and a spring force on other end 200*b* for movement in one direction or another (as opposed to using imbalances between hydraulic loads from a common source on both ends), the control systems of FIGS. 19, and 20 are completely independent of hydraulic system pressure. Thus, it is not necessary to design a compromised system to operate within a potentially wide spectrum of oil pressures, such that may be attributed to individual characteristics of particular engines. In that regard, by designing a system which operates within a narrower range of parameters, it is possible to rapidly and accurately position the spool 200 in its null position for enhanced operation of a VCT system.

The vane 160 is alternatingly urged in clockwise and counterclockwise directions by the torque pulsations in the camshaft 126 and these torque pulsations tend to oscillate vane 160, and, thus, camshaft 126, relative to sprocket 132. However, in the spool position shown in FIGS. 19 and 20, such oscillation is prevented by the hydraulic fluid within recesses 132*a*, 132*b* of sprocket 132 on opposite sides of lobes 160*a*, 160*b*, respectively, of vane 160, because no hydraulic fluid can leave either recesses 132*a* or 132*b*. Both return lines 194, 196 are blocked by the position of vented spool 200. If, for example, it is desired to permit camshaft 126 and vane 160 to move in a counterclockwise direction with respect to sprocket 132, it is only necessary to increase the amount of current to solenoid coil 201*a*. This will "push" armature 201*b* to the right, urge spool 200 to the right, and thereby unblock return line 194. In this condition of the apparatus, counterclockwise torque pulsations in camshaft 126 will pump fluid out of the portion of recess 132*a* and allow lobe 160*a* of vane 160 to move into the other portion of recess 132*a* which has been emptied of hydraulic fluid. However, reverse movement of vane 160 will not occur as the torque pulsations in camshaft 126 become oppositely directed unless and until vented spool 200 moves to the left, because of the blockage of fluid flow through return line 196 by land 200*b* of spool 200. While illustrated as a separate closed passage in FIGS. 19 and 20, the periphery of vane 160 has open oil passage slot 160*c* shown in FIGS. 10, 11, 15, 16 and 17, which permits the transfer of oil between the portion of recess 132*a* on the right side of lobe 160*a* and the portion of recess 132*b* on the right side of lobe 160*b*, which are the non-active sides of lobes 160*a* and 160*b*; thus, counterclockwise movement of vane 160 relative to sprocket 132 will occur when flow is permitted through return line 194 and clockwise movement will occur when flow is permitted through return line 196.

Further, inlet line 182 is provided with extension 182*a* to the non-active side of one of lobes 160*a* or 160*b*, shown as lobe 160*b*, to permit a continuous supply of make-up oil to the non-active sides of lobes 160*a*, 160*b* for better rotational balance, improved damping of vane motion, and improved lubrication of the bearing surfaces of vane 160. The flow of make-up oil does not affect, and is not affected by, the operation of electromechanical actuator 201. Make-up oil will continue to be provided to lobes 160*a* and 160*b*.

Although the best mode contemplated by the inventors for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. An internal combustion engine, comprising:

a crankshaft, said crankshaft being rotatable about an axis;

a camshaft (126), said camshaft being rotatable about a second axis, said camshaft being subject to torque reversals during rotation thereof;

a vane (160), said vane having first and second circumferentially spaced apart lobes (160*a*, 160*b*), said vane being attached to said camshaft, said vane being rotatable with said camshaft and being non-oscillatable with respect to said camshaft;

a housing (132), said housing being rotatable with said camshaft and being oscillatable with respect to said camshaft, said housing having first and second circumferentially spaced apart recesses (132*a*, 132*b*), each of said first and second recesses receiving one of said first and second lobes and permitting oscillating movement of said one of said first and second lobes therein;

means for transmitting rotary movement from said crankshaft to said housing; and, means for controlling the oscillation of said housing, said control means being reactive to torque reversals in said camshaft for varying the position of said housing relative to said camshaft, said control means comprising:

a spool valve body (198);

a spool (200), said spool being reciprocable within said body and having first and second spaced apart lands (200*a*, 200*b*), said spool further having a vent to atmosphere (198*d*);

a first return line means (194) extending from one of said first recess and said second recess to said spool valve body, one of said first and second lands blocking flow through said first return line means in a first range of positions of said spool within said valve body and permitting flow through said first return line means in a second range of positions of said spool within said valve body;

a second return line means (196) extending from the other of said first recess and said second recess to said valve body, the other of said first and second lands blocking flow through said second return line means in said second range of positions of said spool within said valve body, permitting flow through said second return line means in a first portion of said first range of positions of said spool within said valve body, and blocking flow through said second return line means in a second portion of said first range of positions of said spool within said valve body;

an inlet line means (182) extending from said valve body to each of said first recess and said second recess, said inlet line means permitting hydraulic fluid to flow from said valve body to said each of said first recess and said second recess regardless of the position of said spool, said inlet line means having check valve means (184, 186) for preventing the flow of hydraulic fluid from each of said first recess and said second recess to said valve body;

means for sensing (207*a*, 207*b*) the positions of said crankshaft and said camshaft;

an engine control unit (208), said engine control unit for receiving information from said sensing means and for calculating a relative phase angle between said crankshaft and said camshaft using said information;

an electromechanical actuator (201), said electromechanical actuator comprising a variable force solenoid, said variable force solenoid for controlling the position of said spool in response to a signal issued from said engine control unit; and, means for biasing (202) said spool valve, said biasing means for urging said spool valve to a full advance position during periods when said electromechanical actuator is deenergized.

2. An engine according to claim 1 wherein each of said first and second lobes respectively divides each of said first and second recesses into a first portion and a second portion, each of said one of said first portion and said second portion of said each of said first and second recesses being capable of sustaining hydraulic pressure.

3. An engine according to claim 2 wherein said control means is capable of being reversed to transfer hydraulic fluid out of said one of said first portion and said second portion of said each of said first and second recesses and to transfer hydraulic fluid into said other of said first portion and said second portion of said each of said first and second recesses.

4. An engine according to claim 3 wherein said hydraulic fluid comprises engine lubricating oil, said engine further comprising at least one conduit means (230*a*) for transferring engine lubricating oil from a pressurized lubricating oil source (230) to said control means and back again in response to said torque reversals of said camshaft.

5. An engine according to claim 4 further comprising means for hydraulically connecting (182*a*) one of said first portion and said second portion of one of said first recess and said second recess with one of said first portion and said second portion of the other of said first recess and said second recess to permit hydraulic fluid to flow between said one of said first portion and said second portion of said one of said first recess and said second recess and said one of said first portion and said second portion of said other of said first recess and said second recess.

6. An engine according to claim 5 further comprising at least one other conduit means (220*a*), said other conduit means providing communication for the flow of hydraulic fluid through said valve body to said inlet line means, said other conduit means having second check valve means (222*a*) for preventing the flow of hydraulic fluid from said inlet line means through said valve body.

7. An engine according to claim 1 wherein said variable force solenoid comprises:

a coil (201*a*), said solenoid coil for receiving an electrical current from said engine control unit;

an armature (201*b*), said armature being substantially surrounded by said coil, said armature being connected to said spool, said coil, when energized, for creating a magnetic field sufficient to cause said armature to exert a force upon said spool and induce movement in said spool, said movement corresponding to said signal from said engine control unit;

an air gap, said air gap for separating said coil from said armature; and, a housing, said housing for providing an enclosure for said coil, said armature, and said air gap.

8. An engine according to claim 1 wherein said electromechanical actuator further comprises a stroke amplifier, said stroke amplifier providing a net gain in force as applied to said vented spool.

9. An engine according to claim 8 wherein said stroke amplifier comprises a lever arrangement (201*e*).

10. In an internal combustion engine having a variable camshaft timing system for varying the phase angle of a camshaft relative to a crankshaft, a method of regulating the flow of hydraulic fluid from a source to a means for transmitting rotary movement from said crankshaft to a housing, comprising the steps of:

sensing the positions of said camshaft and said crankshaft;

calculating a relative phase angle between said camshaft and said crankshaft, said calculating step using an engine control unit for processing information obtained from said sensing step, said engine control unit further issuing a electrical signal corresponding to said phase angle;

controlling the position of a vented spool slidably positioned within a spool valve body, said controlling step being in response to said signal received from said engine control unit, said controlling step utilizing an electromechanical actuator to vary the position of said vented spool, said electromechanical actuator comprising a variable force solenoid;

supplying hydraulic fluid from said source through said spool valve to a means for transmitting rotary movement to said camshaft, said spool valve selectively allowing and blocking flow of hydraulic fluid through an inlet line and through return lines; and, transmitting rotary movement to said camshaft in such a manner as to vary the phase angle of said camshaft with respect to said crankshaft said rotary movement being transmitted through a housing said housing being mounted on said camshaft, said housing further being rotatable with said camshaft and being oscillatable with respect to said camshaft.

11. The method of claim 10 wherein said variable force solenoid comprises:

a coil, said coil being adapted to receive said electrical signal from said engine control unit;

an armature, said armature being substantially surrounded by said coil, said armature being connected to said spool, said coil, when energized, creating a magnetic field sufficient to cause said armature to exert a force upon said spool and induce movement in said spool, said movement corresponding to said signal from said engine control unit;

an air gap, said air gap separating said coil from said armature; and, a housing, said housing providing an enclosure for said coil, said armature, and said air gap.

12. The method of claim 10 wherein said electromechanical actuator further comprises a stroke amplifier, said stroke amplifier for providing a net gain in force as applied to said spool.

13. The method of claim 12 wherein said stroke amplifier comprises a lever arrangement.

* * * * *

UNITED STATES PATENT AND TRADEMARK OFFICE

CERTIFICATE OF CORRECTION

PATENT NO. : 5,497,738

DATED : March 12, 1996

INVENTOR(S) : Edward C. Siemon and Stanley B. Quinn, Jr.

It is certified that error appears in the above-identified patent and that said Letters Patent is hereby corrected as shown below:

Title page

Under [*] Notice: "Jun. 15, 2010" should be --Sept. 3, 2012--
(Because of GATT, the parent's expiration date has been extended.)

Column 1, line 42, delete "on".

Claim 10, line 28, after "crankshaft" insert a --,--;

Claim 10, line 29, after "housing" insert a --,--.

Signed and Sealed this

Seventeenth Day of September, 1996

*Attest:*

Bruce Lehman

BRUCE LEHMAN

*Attesting Officer*

*Commissioner of Patents and Trademarks*